United States Patent [19]

Wassilieff

[11] Patent Number: 4,569,464

[45] Date of Patent: Feb. 11, 1986

[54] SEALING AND DISTRIBUTING DEVICE FOR CONTAINERS OF FLUIDS

[76] Inventor: Victor Wassilieff, 84 Rue de l'Assomption, Paris, France

[21] Appl. No.: 623,216

[22] Filed: Jun. 21, 1984

[30] Foreign Application Priority Data

Jun. 22, 1983 [IT] Italy ..... 22185/83[U]

[51] Int. Cl.[4] ..... B67D 3/00

[52] U.S. Cl. ..... 222/529; 222/537; 222/546

[58] Field of Search ..... 222/108, 109, 111, 527, 222/529, 537, 499, 507, 538, 546, 566, 571, 525

[56] References Cited

U.S. PATENT DOCUMENTS

| | | | |
|---|---|---|---|
| 2,889,079 | 6/1959 | Livingstone | 222/109 |
| 3,042,271 | 7/1962 | Winstead | 222/529 |
| 3,250,428 | 5/1966 | Rieke | 222/538 X |
| 3,804,305 | 4/1974 | Rieke | 222/538 |
| 4,422,563 | 12/1983 | Babiol | 222/529 X |
| 4,442,949 | 4/1984 | Dwinell et al. | 222/527 X |

FOREIGN PATENT DOCUMENTS

| | | | |
|---|---|---|---|
| 0008282 | 2/1980 | European Pat. Off. . | |
| 2050879 | 4/1971 | France . | |
| 2236747 | 2/1975 | France . | |
| 2028826 | 8/1978 | United Kingdom | 222/525 |

*Primary Examiner*—H. Grant Skaggs
*Assistant Examiner*—Nils E. Pedersen
*Attorney, Agent, or Firm*—Cushman, Darby & Cushman

[57] ABSTRACT

The device comprises a distributing element (36) fastened on to the container (34) and provided with a membrane part (39) connected to the lower end of a distributing tubular part (38), which can assume, by means of the snap bending of the membrane (39), a more inner rest position and a more outer distributing position. A sealing element (40) has a tubular part (42) suitable to be inserted inside the tubular part (38) of the distributing element (36) and protruding beyond it. On the protruding region an annular projection (44) is provided, which, during the axial motion of the sealing element (40), which can be caused either by unscrewing or by pulling out, engages and drags the tubular part (38) of the distributing element (36) snapwise to the distributing position. The sealing element (40) is then disengaged from the distributing element (36). The engagement in correspondence of the lower end of the tubular part (38), below the zone in which the membrane is connected, allows a stronger engagement for extraction purposes and a longer stroke of the distributing element (36) with a higher stability of the positions of it.

6 Claims, 4 Drawing Figures

SEALING AND DISTRIBUTING DEVICE FOR CONTAINERS OF FLUIDS

The present invention relates to a sealing and distributing device for containers of fluids, of the type comprising a distributing element provided with a substantially annular part, suitable to be fastened on to the container in correspondence with a distributing orifice of the same, and with an essentially tubular part substantially coaxial with the annular part and axially movable relatively to it, the two parts being connected by a membrane part, and a sealing element suitable to be joined to the said container to the purpose of sealing it and provided with an axial cylindrical projection and with engagement means for engaging the said tubular part in order to axially moving it from a rest position essentially in the interior of the container to a distributing position sticking out of the container and vice-versa, the sealing element being removable from the said distributing element in the distributing position.

A device of this type is known form the U.S. Pat. No. 2,889,079. In this device, the sealing element has the form of a capsule, suitable to be screwed on the container, which is in this case a bottle, and has inside in its centre a small cylindrical projection with an annular enlarged section on its free end. Said enlarged section is suitable to engage an annular groove cut in the interior of the tubular part in correspondence of the outside end of the distributing element, so that when unscrewing the capsule, the axial shifting simultaneously takes place of the distributing element from the rest position to the distributing position. In this position, the capsule can then be removed by means of the axial disjunction from the tubular part. When passing from the rest position to the distributing position the membrane part is bent from a substantially concave configuration to a convex one, and vice-versa in the contrary movement.

This device has however the drawback that the distributing element can project only a little from the container in the distributing position, in that the membrane part allows only a reduced axial stroke to take place. This causes difficulties in pouring and soilings of the outside surface of the container, all the more that the membrane element is provided with circumferentially distributed openings, which are not practically closed in the distributing position.

On the other side, should a more protruding distributing element in the pouring operation be desired, the length of such an element should be increased, and as a result it would be no longer possible to make the membrane element to bend, or to seal the container with the capsule. A longer stroke of the membrane cannot be obtained with a too soft membrane, as in this case a stable distributing position would not be obtained. The membrane should therefore made more rigid, but this would not allow any longer the axial extraction of the distributing element in that the annular enlarged section on the projection of the capsule would rapidly escape out of the groove of the tubular element because of the radial dilatation of the latter. On the contrary, giving to the enlarged section and to the engagement annular groove a more pronounced profile, it would no longer be possible to detach the capsule to the purpose of pouring the liquid out of the container.

Another sealing and distributing device in the form of a suitable to be screwed capsule provided with an inside projection with an enlarged annular edge at the free end of the projection, is known from the European Patent Application No. 0 008 282. In this device a relatively long tubular distributing element is provided which is slipped out to the extracted position by means of the capsule, but no membrane is provided.

This device has the drawback that the tubular distributing element in the extracted position does not guarantee a stable distributing position, but it can be easily axially moved, with the consequence that it can change its position even during the pouring of the liquid out of the container.

The purpose of the present invention is to overcome the drawbacks mentioned, providing a sealing and distributing device of the type mentioned, such as to allow the distributing element to be extracted to a position which makes it possible to easily pour the content out of the container without the danger of soiling the container or the device itself, and such as to guarantee at the same time the stability of the distributing position of the distributing element. This purpose is achieved thanks to the fact that the projection of the sealing element is longer than said tubular part and has the engagement means with said tubular part on its region protruding beyond the end of said tubular part, the projection of the sealing element being removable through the tubular part of said distributing element after the axial shifting of the said tubular part to the distributing position and after the liberation of the said engagement means by the cooperable means of the said tubular part.

Advantageously in a device of this type the membrane can be made stiffer and longer, the risk not existing of not being able to extract the tubular part of the distributing element when so acting, in that the engagement between the projection and the distributing element takes place below the region of connection of the membrane to the tubular part, the upwards motion of the sealing element consequently causing firstly a radial tightening of the membrane which tends to move towards the centre of the system, thus increasing the efficiency of the engagement between the sealing element and the distributing element.

The possibility of using a relatively stiffer and longer membrane renders more stable the rest and distributing position and allows having a distributing element with a relatively longer tubular part, thus rendering easier the pouring the fluids without soiling.

Further advantages and details of a device according to the invention will become more evident from the following description of two examples of embodiments of the invention itself, which are illustrated in the attached drawings, in which.

Figure 1:
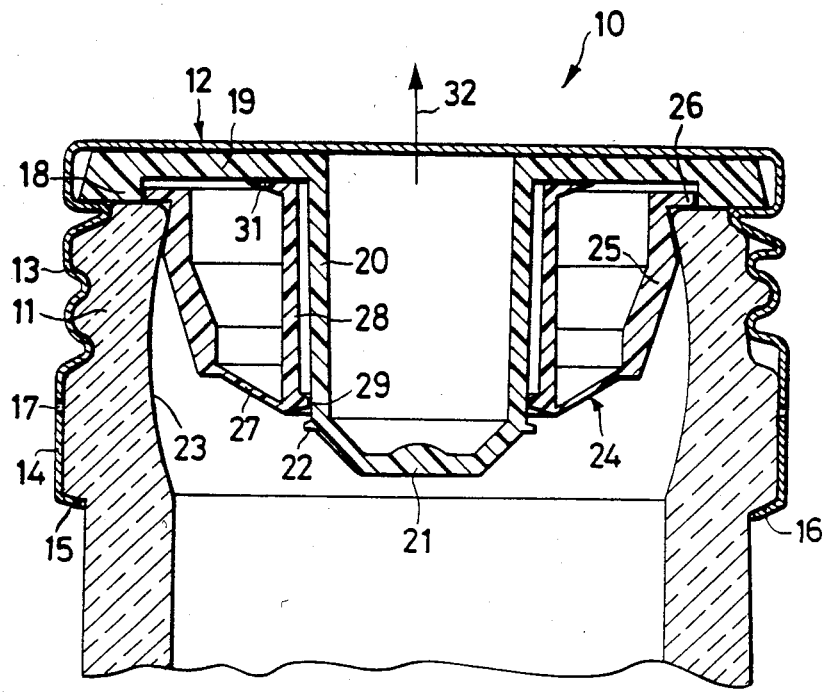
FIG. 1 is an axial section view of a sealing and distributing device according to the invention, applied to the neck of a bottle and in the sealing position.
Figure 2:
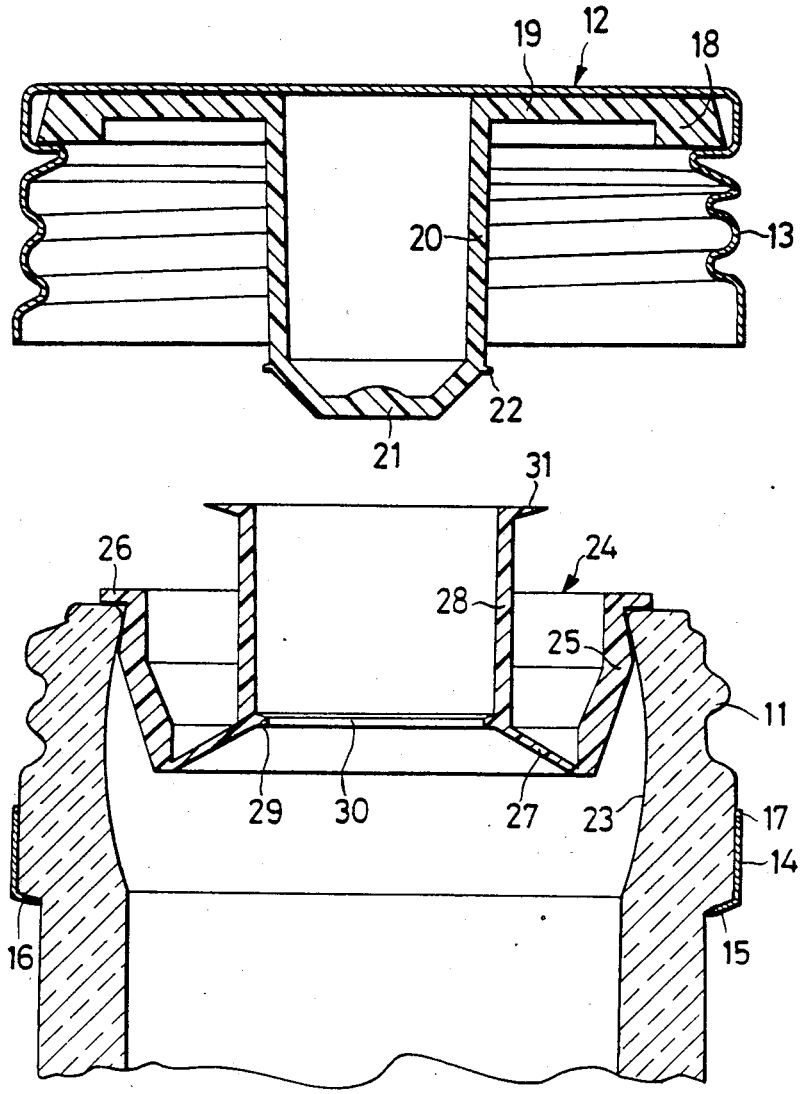
FIG. 2 is an axial section view of the same device of FIG. 1, in which the sealing element has been completely withdrawn and the distributing element is in the extracted position for the distributing operation.

With reference initially to the FIGS. 1 and 2, a sealing and distributing device 10 for a container of fluids according to the invention is applied to the end of a threaded neck 11 of a bottle containing a fluid or liquid such as oil, wine, or others.

The device 10 comprises a sealing element 12 having the form of a capsule, for instance made of metal, which can be fixed on the bottle by means of a threading 13, complementary to the threading of the neck 11, and provided on the lower end of its side surface with a guarantee ring 14 having an annular edge 15 bent around an undercut 16 of the neck 11 of the bottle.

A line 17 of fracture or lower resistance connects the guarantee ring 14 to the remaining of the sealing capsule 12 in a known manner.

In correspondence of the upper surface of the sealing capsule 12 an annular edge 18 is locked inside the capsule of an element 19 provided towards the inside of the capsule 12 with a projection 20 of tubular shape, coaxial with the capsule 12 and closed by a cross bottom 21.

Close to the said bottom 21 engagement means are provided such as an annular projection 22, protruding towards the outside of the tubular part 20.

A substantial toroidal surface 23 in the inside of the neck 11 of the bottle accomodates a distributing element, generally indicated as 24. This element is provided with an essentially fixed part 25 having a substantially cylindrical hollow shape with flaring outside walls, such as to fit with geometrical engagement to the top part of the surface 23, and with an annular part 26 radially protruding towards the outside and suitable to apply a pressure on the free end of the neck 11 of the bottle so as to firmly fasten the element 24 in cooperation with the part 25.

An annular yielding membrane part 27 connects the said substantially fixed part 25 to a substantially tubular part 28, coaxial with the part 21 and with the part 25 and having an inside diameter slightly longer than the outside diameter of the part 20 of the capsule 12. An annular projection 29 protrudes towards the inside of the tubular part 28 in correspondence of the lower end of the distributing element 24, defining an orifice 30 having a diameter substantially equal to the outside diameter of the part 20. Such projection 29 is suitable to engage the outside projection 22 of the part 20 as will be seen from the following description. A pouring lip 31 of annular shape and radially protruding towards the outside is provided on the free end of the tubular part 28 and is forced axially by the capsule 12 for tightly closing of the bottle.

As it will be seen, the membrane part 27 is connected to the substantially tubular part 28 in correspondence of the end of such tubular part which lies in the inside of the container. Moreover, the projection of the capsule 12 defined by the tubular part 20 is longer than the tubular part 28 and passes through it, the engagement means 22 being positioned on the section of the tubular part 20 which protrudes beyond the end said.

The sealing device 10, in the position of container sealed, appears as shown in FIG. 1, the sealing capsule being still connected to the guarantee ring 14.

The tubular part 20, constrained to the sealing capsule 12, is inserted in the tubular part 28 in order to keeping the orifice 30 tightly sealed, the first annular projection 22 being placed under the second annular projection 29 of the distributing element 24, which is in the rest position substantially in the inside of the neck 11 of the bottle.

Acting on the sealing capsule 12 in order to unscrewing it from the neck 11 of the bottle, the upper part of the capsule is separated from the guarantee ring 14 due to the presence of the fracture line 17.

The capsule 12 axially moving in the direction of the arrow 32 drags with itself the tubular part 20, whose first projection 22 engages the second projection 29 of the distributing element 24. The tubular part 28, thanks to the presence of the membrane 27, follows the axial movement of the tubular part 20 until the axial force, applied by means of the unscrewing, becomes larger than the engagement resistance force between the two projections 22 and 29, which disengage from each other.

The sealing capsule 12 with the tubular element 20 can be removed from the neck 11 of the bottle on which the distributing element 24 remains with the tubular part 28 extracted in the distributing position (FIG. 2) intended for facilitating the pouring of the fluid flowing from the orifice 30.

The lip 31 allows the flow to be stopped at the end of the pouring operation and prevents the fluid from soiling the bottle, in that the ultimate drop is collected in the region defined by the part 25, the membrane 27 and the tubular part 28. When the capsule 12 is screwed on the neck 11 of the bottle, the first projection 22 comes in contact with the second projection 29 pushing it to the opposite direction to that shown by the arrow 32. Said push causes the tubular part 28 to re-enter as far as it is so allowed by the constraint exerted by the membrane 27.

A further screwing of the capsule causes the exceeding of the resistance force between the two projections 22 and 29 and consequently the snap insertion of the projection 22 inside the orifice 30 and its positioning below the projection 29 (FIG. 1), with the complete locking of the sealing device.

Thanks to the engagement means 22 provided in correspondence of the lower end of the tubular part 28, i.e. below the zone where the membrane 27 is connected thereto, it bcomes possible to make the tubular part 28 relatively longer, with a consequent greater possiblity of extraction, while assuring the axial extraction of the tubular element 28 also in the case of a relatively rigid membrane 27, necessary in order to making stable enough mainly the extraction position, in that the axial motion of extraction of the projection 22 involves at a first time the membrane 27 to tend to radially tighten, thus increasing the extraction engagement.

Figure 3:
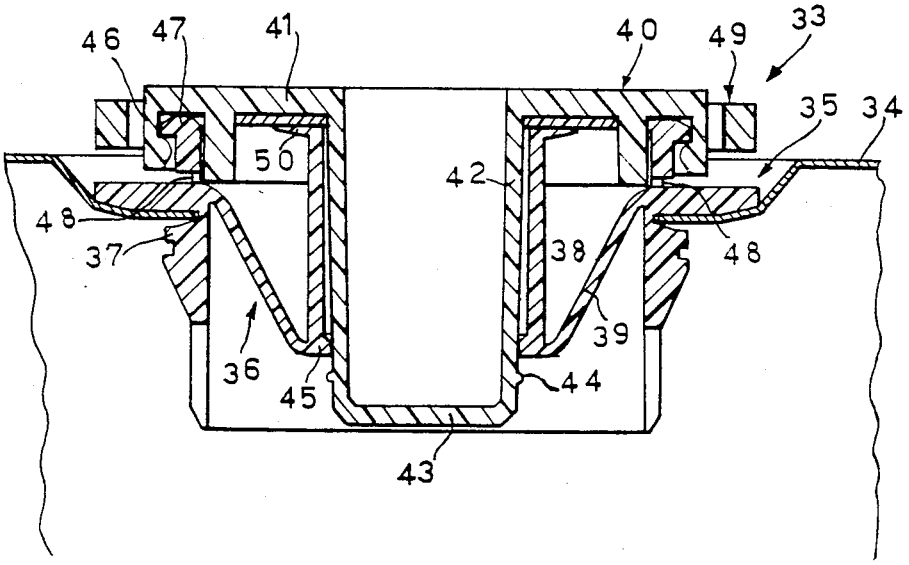
FIG. 3 is an axial section view of another form of embodiment of the invention in the sealing position, the device being now applied to a container in the form of a can.
Figure 4:
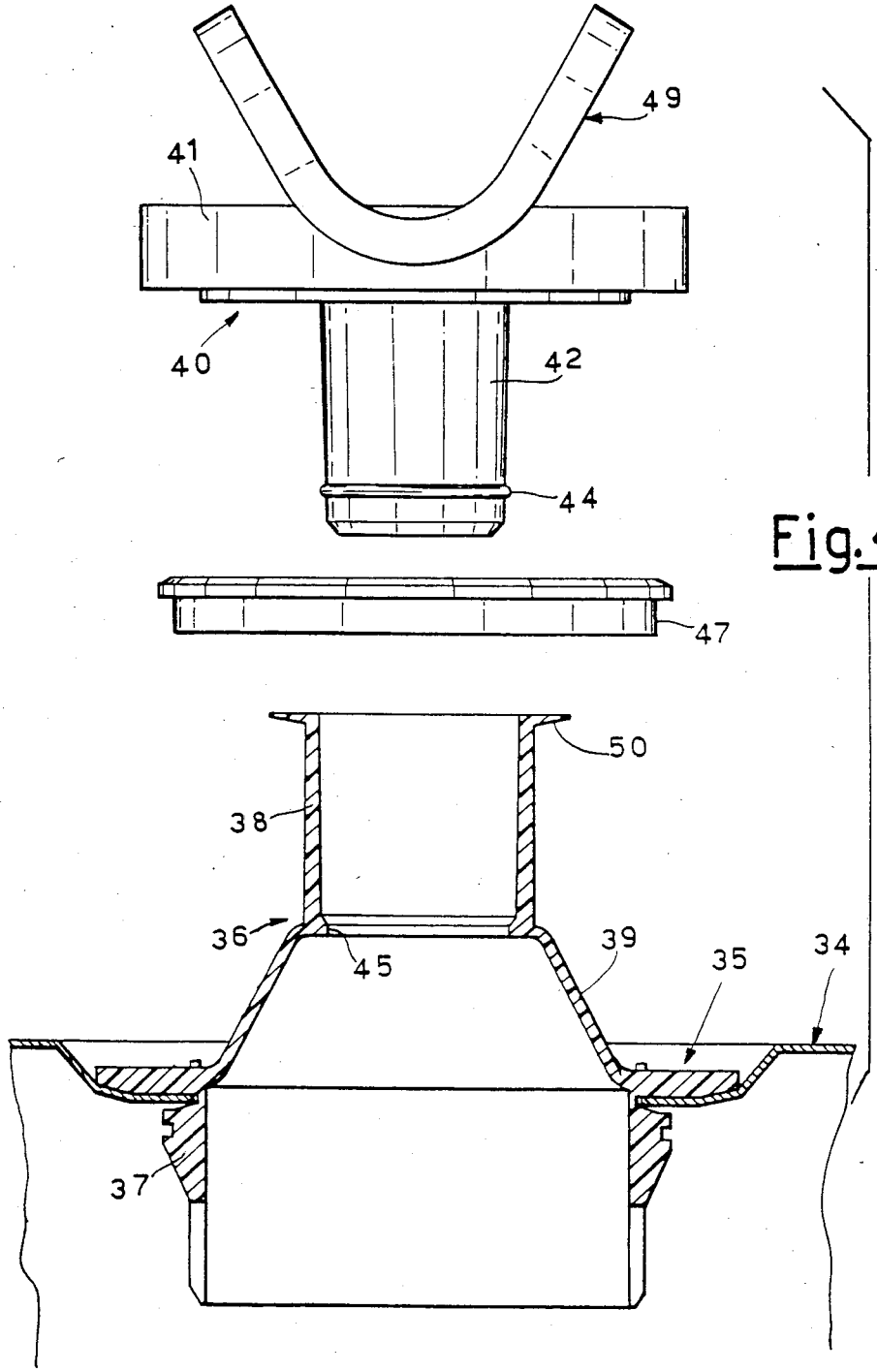
FIG. 4 is an axial section view of the distributing element of FIG. 3 in its extracted position, the other elements of the device being shown in full view.

These advantages shall appear still more evident from the following description of the embodiment shown in FIGS. 3 and 4.

In this case, the sealing device 33 is applied to a container 34 in the form of a can in correspondence of a distributing orifice 35 of the same. The device comprises a distributing element 36 provided with a substantially annular part 37 suitable to be fastened on the container 34 around the orifice 35, such part being suitably shaped to this purpose. The device comprises moreover a substantially tubular part 38 coaxial with the annular part 37, the two parts 37 and 38 being connected by a membrane part 39. This latter is connected to the tubular part 38 in correspondence of the lower end of it.

The sealing element 40, substantially having the shape of a plug, has a head 41 forming only one piece with an axial substantially cylindrical hollow part 42, closed by a bottom part 43. The part 42 has an outside diameter slightly shorter than the inside diameter of the tubular part 38 and is longer than the part 38, it is provided with engagement means such as an outside annular projection 44 in correspondence of the lower section protruding beyond the lower end of the tubular part 38 of the distributing element 36, in particular in the nearby of the bottom 43. The annular projection 44 is suitable to interfere with an annular projection 45 shaped inside the tubular part 38 in correspondence of the lower end of the same and such as to define a distributing orifice having a diameter substantially equal to the outside diameter of the part 42.

The head 41 is provided with an edge 46 bent towards the bottom, by means of which it engages internally an annular sealing part 47 rigid with the distributing element 36, but suitable to be pulled away from it in a known manner due to the weakening zones 48 positioned between the part 47 and the part 37 of the distributing element 36.

Externally to the head 41 a pull out ring 49 is positioned, it too being of a known type, which is provided with two parts suitable to be bent upwards for being grasped by two fingers to the purpose of raising the sealing element 40.

The tubular part 38 has conveniently an annular pouring lip 50, similar to the lip 31 of the embodiment shown in FIGS. 1 and 2.

With reference to this embodiment, the membrane 39 has a longer shape, thus allowing, the other characteristics being the same, the tubular part 38 to be made longer and moreover allowing this part to protrude to a greater extent from the container 34 in the distributing position, as it can be clearly understood from a comparison of FIG. 4 with FIG. 2.

In the sealing position of FIG. 3 the sealing element 40 is connected by means of the part 47 to the distributing element 36, whose pouring orifice is tightly sealed by the part 42 in correspondence of the annular inside projection 45. By bending the two sections of the pull out ring 29 upwards and pulling them upwards the tearing is obtained at a first time of the sealing element 40 away from the distributing element 36 and, subsequently, following the engagement of the projections 44 and 45, the axial motion of the tubular part 38 from the rest position of FIG. 3 to the distributing position of FIG. 4. It must be observed that in this case too the first engagement phase of the projections 44 and 45 involves a strong engagement thanks to the trend of the membrane 39 to radially tighten, even to a larger extent thanks to the relatively longer shape of the membrane 39.

The separation of the sealing element 40 from the tubular section 38 upon reaching the distributing position substantially at the outside of the container 34 (FIG. 4) does not involve any difficulties, in that in the disengagement position of the projections 44 and 45 the membrane 39 does not counteract the radical dilatation of the lower part of the tubular part 38.

What has been mentioned in regard to the extraction is valid, to the contrary, for the re-sealing operation of the container 34.

As it is shown in FIG. 4, the part 47 is separated in the first opening operation.

As it can be noticed, in both the two embodiments described, only one single pulling operation is necessary for turning the position of the distribution element form the rest position to the distributing position, with the further advantage that the sealing element is completely detachable from the container, the pouring being as a consequence made easier. The sealing element can anyway be applied again to the purpose of tightly sealing the container.

It can be noticed that a device according to the invention has very reduced dimensions in regard to the features it offers, and can be produced with definitely low costs as for matter and other costs.

I claim:

1. Sealing and distributing device for containers of fluids, comprising a distributing element (24,36) provided with a part (25,26;37) of substantially annular shape, suitable to be fixed to the container (11,34) in correspondence of a distribution orifice (35) of the same, and with a substantially tubular part (28,38) coaxial with the annular part (25,26;37) and axially movable relatively to it, the two parts (25,26;37 and respectively 28,38) being connected to each other by a membrane part (27,39) and comprising a sealing element (12,40) suitable to be connected to the said container (11,34) to the purpose of sealing it and provided with an axial cylindrical projection (20,42) having engagement means (22,44) with the said tubular part (28,38) for causing the axial shifting of it from a rest position substantially inside the container (11,34) to a distributing position extending outside from the container (11,34) and vice-versa, the sealing element (12,40) being removable from said distributing element (24,36) in the distributing position, characterized in that the projection (20,42) of the sealing element (12,40) is longer than said tubular part (28,38) and has the engagement means (22,44) with said tubular part (28,38) on its region protruding beyond the end of said tubular part (28,38), the projection (20,42) of the sealing element (12,40) being removable through the tubular part (28,38) of said distributing element (24,36) after the axial shifting of the said tubular part (28,38) to the distributing position and after the liberation of the said engagement means (22,44) by the cooperable means of the said tubular part (28,38).

2. Device as claimed in claim 1, characterized in that said engagement means consists of an annular projection (22,44).

3. Device as claimed in claim 1, characterized in that said end has an inside annular projection (29,45) defining a pouring orifice having a diameter substantially equal to the outside diameter of the said axial cylindrical projection (20,42).

4. Device as claimed in claim 1, characterized in that the said axial cylindrical projection (20,42) of said sealing element (12,40) is closed by said engagement means (22,44).

5. Device as claimed in claim 1, characterized in that the part of the said sealing element (12,40) fixed in closed position to the container (11,34) or to the part of the distributing element (24,36) fixed to the container (11,34) forces axially against the pouring lip (31,50) for tightly closing of the said container (11,34).

6. Device as claimed in claim 1, characterized in that the membrane part (27,39) is connected to the substantially tubular part (28,38) in correspondence of the end of said tubular part (28,38) lying in the container (11,34).

* * * * *